US008833441B2

(12) United States Patent
Fielder et al.

(10) Patent No.: US 8,833,441 B2
(45) Date of Patent: Sep. 16, 2014

(54) CABLE SUSPENDED PUMPING SYSTEM

(75) Inventors: Lance I. Fielder, Sugar Land, TX (US); Robert Nicholas Worrall, Naples, FL (US)

(73) Assignee: Zeitecs B.V., Rijswijk (NL)

( * ) Notice: Subject to any disclaimer, the term of this patent is extended or adjusted under 35 U.S.C. 154(b) by 253 days.

(21) Appl. No.: 12/467,539

(22) Filed: May 18, 2009

(65) Prior Publication Data

US 2010/0288493 A1 Nov. 18, 2010

(51) Int. Cl.
*E21B 4/04* (2006.01)
*E21B 43/12* (2006.01)
*F04B 47/02* (2006.01)

(52) U.S. Cl.
CPC ..... *E21B 43/128* (2013.01); *F04B 47/02* (2013.01)
USPC ..... 166/66.4; 166/385; 166/105

(58) Field of Classification Search
USPC ..... 166/250.15, 369, 66.4, 385, 105; 417/1, 417/423.3
See application file for complete search history.

(56) References Cited

U.S. PATENT DOCUMENTS 1,970,295 A * 8/1934 Fitzpatrick ..... 166/60
2,915,739 A * 12/1959 Buck et al. ..... 340/853.2
3,468,258 A 9/1969 Arutunoff
4,352,394 A 10/1982 Zehren
4,928,771 A 5/1990 Vandevier
5,086,196 A 2/1992 Brookbank et al.
5,193,985 A * 3/1993 Escue et al. ..... 417/53
5,207,273 A 5/1993 Cates et al.
5,732,776 A * 3/1998 Tubel et al. ..... 166/250.15
6,138,765 A 10/2000 Russell et al.
6,143,988 A 11/2000 Neuroth et al.
6,229,453 B1 * 5/2001 Gardner et al. ..... 340/853.8
6,873,267 B1 * 3/2005 Tubel et al. ..... 340/853.3
7,748,449 B2 * 7/2010 Bussear et al. ..... 166/250.08
2004/0183491 A1 9/2004 Sidey
2004/0188096 A1 * 9/2004 Traylor ..... 166/369
2005/0150661 A1 * 7/2005 Kenison et al. ..... 166/387

(Continued)

FOREIGN PATENT DOCUMENTS

CN 101064200 A 10/2007
GB 2448928 11/2008

OTHER PUBLICATIONS

Baker Hughes—Centrilift Product Report, Alternative Deployed ESP System, Cable/Rod Deployed ESP Systems, Sep. 2008, 6 pages.

(Continued)

*Primary Examiner* — Kenneth L Thompson
*Assistant Examiner* — Kipp Wallace
(74) *Attorney, Agent, or Firm* — Patterson & Sheridan, L.L.P.

(57) ABSTRACT

Embodiments of the present invention generally relate to a cable suspended pumping system. In one embodiment, a method of producing fluid from a reservoir includes deploying a pumping system into a wellbore to a location proximate the reservoir using a cable. The pump assembly includes a motor, an isolation device, a pump, and a power conversion module (PCM). The method further includes setting the isolation device, thereby rotationally fixing the pumping system to a tubular string disposed in the wellbore and isolating an inlet of the pump from an outlet of the pump; supplying a DC power signal from the surface to the PCM via the cable; and supplying a second power signal to the motor, thereby operating the pump and pumping reservoir fluid from the reservoir to the surface.

36 Claims, 2 Drawing Sheets

(56) References Cited

U.S. PATENT DOCUMENTS

| | | | | |
|---|---|---|---|---|
| 2006/0151211 | A1* | 7/2006 | Coenen et al. | 175/19 |
| 2007/0175633 | A1 | 8/2007 | Kosmala et al. | |
| 2007/0252717 | A1 | 11/2007 | Fielder | |
| 2008/0031394 | A1* | 2/2008 | Tominaga | 376/210 |
| 2008/0236821 | A1 | 10/2008 | Fielder | |
| 2008/0286131 | A1* | 11/2008 | Yuratich et al. | 417/410.1 |
| 2009/0044938 | A1* | 2/2009 | Crossley et al. | 166/250.15 |
| 2009/0047157 | A1* | 2/2009 | Reid et al. | 417/423.3 |
| 2009/0056939 | A1 | 3/2009 | Hackworth et al. | |
| 2009/0194296 | A1* | 8/2009 | Gillan et al. | 166/385 |
| 2010/0116506 | A1* | 5/2010 | Sbordone et al. | 166/345 |

OTHER PUBLICATIONS

PCT Search Report and Written Opinion for International Application No. PCT/US2010/031795 dated Nov. 10, 2010.

EPO Office Action dated Feb. 5, 2013, European Patent Application No. 10716182.0.

Chinese Office Action dated Sep. 17, 2013, for Chinese Patent Application No. 201080021657.6.

Chinese Office Action dated Mar. 10, 2014, for Chinese Patent Application No. 201080021657.6.

* cited by examiner

CABLE SUSPENDED PUMPING SYSTEM

BACKGROUND OF THE INVENTION

1. Field of the Invention

Embodiments of the present invention generally relate to a cable suspended pumping system.

2. Description of the Related Art

The oil industry has utilized electric submersible pumps (ESPs) to produce high flow-rate wells for decades, the materials and design of these pumps has increased the ability of the system to survive for longer periods of time without intervention. These systems are typically deployed on the tubing string with the power cable fastened to the tubing by mechanical devices such as metal bands or metal cable protectors. Well intervention to replace the equipment requires the operator to pull the tubing string and power cable requiring a well servicing rig and special spooler to spool the cable safely. The industry has tried to find viable alternatives to this deployment method especially in offshore and remote locations where the cost increases significantly. There has been limited deployment of cable inserted in coil tubing where the coiled tubing is utilized to support the weight of the equipment and cable, although this system is seen as an improvement over jointed tubing the cost, reliability and availability of coiled tubing units have prohibited use on a broader basis.

SUMMARY OF THE INVENTION

Embodiments of the present invention generally relate to a cable suspended pumping system. In one embodiment, a method of producing fluid from a reservoir includes deploying a pumping system into a wellbore to a location proximate the reservoir using a cable. The pump assembly includes a motor, an isolation device, a pump, and a power conversion module (PCM). The method further includes setting the isolation device, thereby rotationally fixing the pumping system to a tubular string disposed in the wellbore and isolating an inlet of the pump from an outlet of the pump; supplying a DC power signal from the surface to the PCM via the cable; and supplying a second power signal to the motor, thereby operating the pump and pumping reservoir fluid from the reservoir to the surface.

In another embodiment, pumping system includes: a submersible electric motor operable to rotate a drive shaft; a pump rotationally fixed to the drive shaft; an isolation device operable to expand into engagement with a casing string, thereby fluidly isolating an inlet of the pump from an outlet of the pump and rotationally fixing the motor and the pump to the casing string; a cable having two or less conductors and a strength sufficient to support the motor, the pump, the isolation device, and a power conversion module (PCM); and the PCM operable to receive a DC power signal from the cable, and supply a second power signal to the motor.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
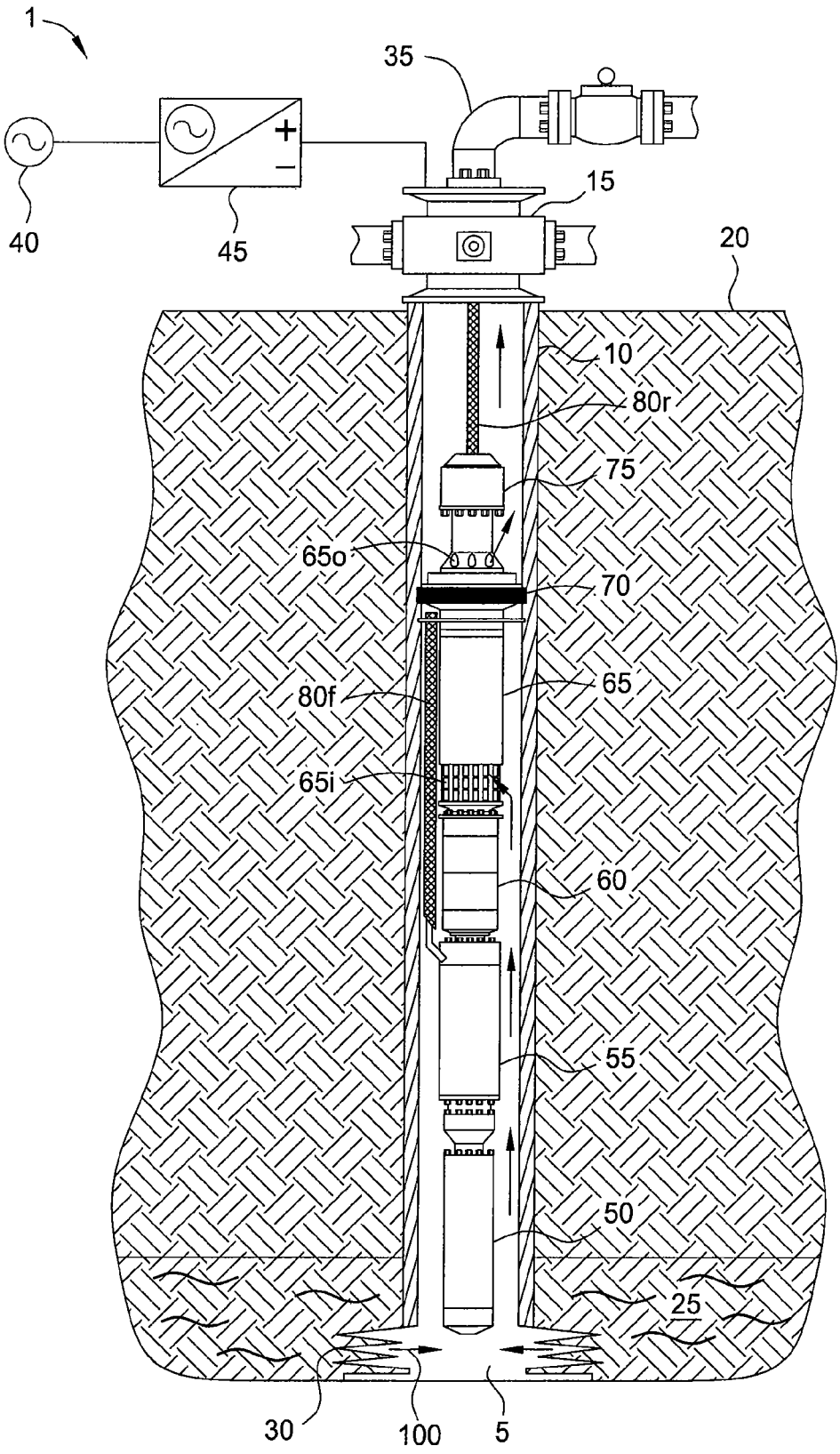
FIG. 1 illustrates an ESP system deployed in a wellbore, according to one embodiment of the present invention.

FIG. 1 illustrates an ESP system 1 deployed in a wellbore 5, according to one embodiment of the present invention. The wellbore 5 has been drilled from a surface of the earth 20 or floor of the sea (not shown) into a hydrocarbon-bearing (i.e., crude oil and/or natural gas) reservoir 25. A string of casing 10 has been run into the wellbore 5 and set therein with cement (not shown). The casing 10 has been perforated 30 to provide to provide fluid communication between the reservoir 25 and a bore of the casing 10. A wellhead 15 has been mounted on an end of the casing string 10. An outlet line 35 extends from the wellhead 15 to production equipment (not shown), such as a separator. Alternatively, the casing 10 may be lined by a removable production liner (not shown) to protect the cemented casing from corrosion by the reservoir fluid 100.

The ESP system 1 may include a surface controller 45, an electric motor 50, a power conversion module (PCM) 55, a seal section 60, a pump 65, an isolation device 70, a cablehead 75, and a power cable 80*r*. Housings of each of the components 50-75 may be longitudinally and rotationally fixed, such as by flanged or threaded connections.

The surface controller 45 may be in electrical communication with an alternating current (AC) power source 40, such as transmission lines. The surface controller 45 may include a transformer (not shown) for stepping the voltage of the AC power signal from the power source 40 to a medium voltage (V) signal, such as five to ten kV, and a rectifier for converting the medium voltage AC signal to a medium voltage direct current (DC) power signal for transmission downhole via power cable 80*r*. The surface controller 45 may further include a data modem (not shown) and a multiplexer (not shown) for modulating and multiplexing a data signal to/from the downhole controller with the DC power signal. The surface controller 45 may further include a transceiver (not shown), such as a satellite transceiver, for data communication with a remote office (not shown). The surface controller 45 may further include an operator interface (not shown), such as a video-display, touch screen, and/or USB port.

The cable 80*r* may extend from the surface controller 45 through the wellhead 15 or connect to leads which extend through the wellhead 15 and to the surface controller 45. The cable 80*r* may be received by slips or a clamp (not shown) disposed in or proximate to the wellhead 15 for longitudinally fixing the cable 80*r* to the wellhead 15 during operation of the ESP system 1. The cable 80*r* may extend into the wellbore 5 to the cablehead 75. Since the power signal may be DC, the cable 80*r* may only include two conductors arranged coaxially.

Figure 2A:
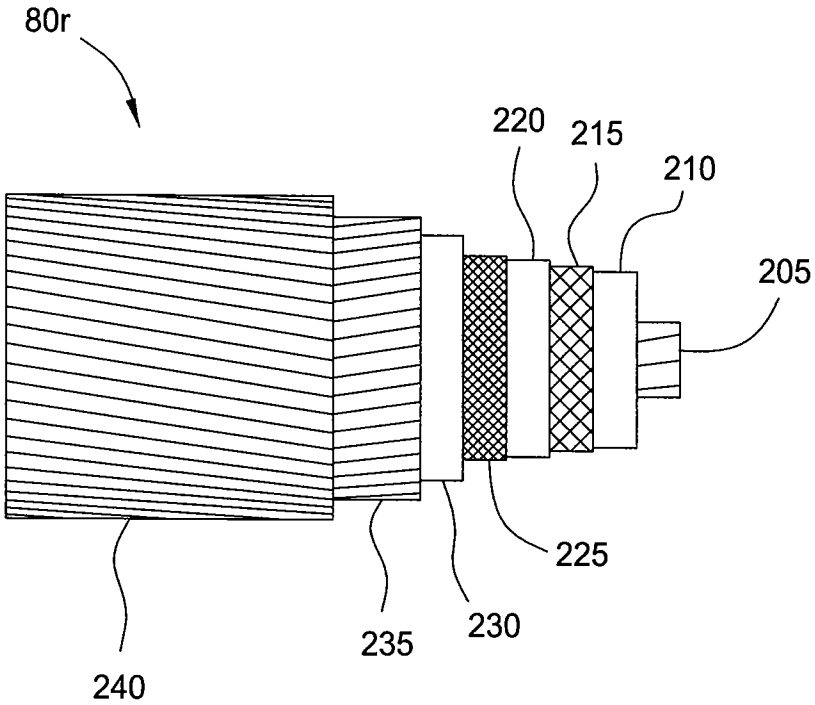
FIG. 2A is a layered view of the power cable.
Figure 2B:
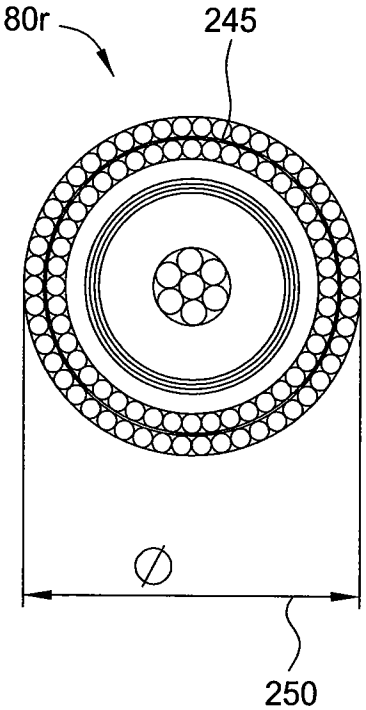
FIG. 2B is an end view of the power cable.

FIG. 2A is a layered view of the power cable 80*r*. FIG. 2B is an end view of the power cable 80*r*. The cable may include an inner core 205, an inner jacket 210, a shield 215, an outer jacket 230, and armor 235, 240.

The inner core 205 may be the first conductor and made from an electrically conductive material, such as aluminum, copper, aluminum alloy, copper alloy, or steel. The inner core 205 may be solid or stranded. The inner jacket 210 may electrically isolate the core 205 from the outer conductor 215 and be made from a dielectric material, such as a polymer (i.e., an elastomer or thermoplastic). The shield 215 may serve as the second conductor and be made from the electrically conductive material. The shield 215 may be tubular, braided, or a foil covered by a braid. The outer jacket 230 may electrically isolate the shield 215 from the armor 235, 240 and be made from an oil-resistant dielectric material. The armor may be made from one or more layers 235, 240 of high strength material (i.e., tensile strength greater than or equal to two hundred kpsi) to support the deployment weight (weight of the cable and the weight of the components 50-75, 80*f* so that the cable 80*r* may be used to deploy and remove the components 50-75 into/from the wellbore 5. The high strength material may be a metal or alloy and corrosion resistant, such as galvanized steel or a nickel alloy depending on the corrosiveness of the reservoir fluid 100. The armor may include two contra-helically wound layers 235, 240 of wire or strip.

Additionally, the cable 80*r* may include a sheath 225 disposed between the shield 215 and the outer jacket 230. The sheath 225 may be made from lubricative material, such as polytetrafluoroethylene (PTFE) or lead and may be tape helically wound around the shield 215. If lead is used for the sheath, a layer of bedding 220 may insulate the shield 215 from the sheath and be made from the dielectric material. Additionally, a buffer 245 may be disposed between the armor layers 235, 240. The buffer 245 may be tape and may be made from the lubricative material.

Due to the coaxial arrangement, the cable 80*r* may have an outer diameter 250 less than or equal to one and one-quarter inches, one inch, or three-quarters of an inch.

Additionally, the cable 80*r* may further include a pressure containment layer (not shown) made from a material having sufficient strength to contain radial thermal expansion of the dielectric layers and wound to allow longitudinal expansion thereof. The material may be stainless steel and may be strip or wire. Alternatively, the cable 80*r* may include only one conductor and the casing 10 may be used for the other conductor.

The cable 80*r* may be longitudinally coupled to the cablehead 75 by a shearable connection (not shown). The cable 80*r* may be sufficiently strong so that a margin exists between the deployment weight and the strength of the cable. For example, if the deployment weight is ten thousand pounds, the shearable connection may be set to fail at fifteen thousand pounds and the cable may be rated to twenty thousand pounds. The cablehead 75 may further include a fishneck so that if the components 50-75, 80*f* become trapped in the wellbore, such as by jamming of the isolation device 70 or buildup of sand, the cable 80*r* may be freed from rest of the components by operating the shearable connection and a fishing tool (not shown), such as an overshot, may be deployed to retrieve the components 50-75, 80*f*.

The cablehead 75 may also include leads (not shown) extending therethrough, through the outlet 65*o*, and through the isolation device 70. The leads may provide electrical communication between the conductors of the cable 80*r* and conductors of a flat cable 80*f*. The flat cable 80*f* may extend along the pump 65, the intake 65*i*, and the seal section 60 to the downhole controller 55. The flat cable 80*f* may have a low profile to account for limited annular clearance between the components 60, 65, 65*i* and the casing 10. Since the flat cable 80*f* may conduct the DC signal, the flat cable may only require two conductors (not shown) and may only need to support its own weight. The flat cable 80*f* may be armored by a metal or alloy.

The motor 50 may be a two-pole, three-phase, squirrel-cage induction type. The motor 50 may run at a nominal speed of thirty-five hundred rpm at sixty Hz. The motor may be filled with a dielectric, thermally conductive liquid lubricant, such as oil. The motor 50 may be cooled by thermal communication with the reservoir fluid 100. The motor 50 may include a thrust bearing (not shown) for supporting a drive shaft (not shown). The motor 50 may be located at a sufficient distance above the perforations 30 to ensure adequate cooling or the motor 50 may instead be shrouded. In operation, the motor may rotate the shaft, thereby driving the pump 65. Alternatively, the motor 50 may be a switched reluctance motor (SRM). Alternatively, the motor 50 may be any other type of induction motor, any other type of synchronous motor, or a DC motor.

The PCM 55 may have a longitudinal bore therethrough for allowing the motor shaft to extend to the seal section 60 and conducting lubricant to the shaft seal. The PCM 55 may include a power supply (not shown), a motor controller (not shown), a modem (not shown), and demultiplexer (not shown). The modem and demultiplexer may demultiplex a data signal from the DC power signal, demodulate the signal, and transmit the data signal to the motor controller.

The power supply may include one or more inverters for converting the medium voltage DC power signal into a three-phase medium voltage AC power signal. Alternatively, the power supply may further include one or more DC/DC converters, each DC/DC converter including an inverter, a transformer, and a rectifier for converting the DC power signal into an AC power signal and stepping the voltage from medium to low, such as less than or equal to one kV. Further, the power supply may include multiple DC/DC converters in series to gradually step the DC voltage from medium to low. The frequency of the AC power signal may be fixed or variable, depending on the type of motor controller employed.

The motor controller may be a switchboard or a variable speed drive (VSD). The motor controller may be in data communication with one or more sensors (not shown) distributed throughout the components 50-75. A pressure and temperature (PT) sensor may be in fluid communication with the reservoir fluid 100 entering the intake 65*i*. A gas to oil ratio (GOR) sensor may be in fluid communication with the reservoir fluid entering the intake 65*i*. A second PT sensor may be in fluid communication with the reservoir fluid discharged from the outlet 65*o*. A temperature sensor (or PT sensor) may be in fluid communication with the lubricant to ensure that the motor and downhole controller are being sufficiently cooled. Multiple temperature sensors may be included in the PCM for monitoring and recording temperatures of the various electronic components. A voltage meter and current (VAMP) sensor may be in electrical communication with the cable 80*r* to monitor power loss from the cable. A second VAMP sensor may be in electrical communication with the power supply output to monitor performance of the power supply. Further, one or more vibration sensors may monitor operation of the motor 50, the pump 65, and/or the seal section 60. A flow meter may be in fluid communication with the discharge 65*o* for monitoring a flow rate of the pump 65. Utilizing data from the sensors, the motor controller may monitor for adverse conditions, such as pump-off, gas lock, or abnormal power performance and take remedial action before damage to the pump 65 and/or motor 50 occurs.

Alternatively, if the motor is an SRM, the motor controller may receive the medium voltage DC signal from the cable or a low voltage DC signal from the power supply and sequentially switch the DC signal to one or more phases of the motor (i.e., one or two-phase excitation). The motor controller may control the speed of the motor by controlling the switching frequency. The motor controller may be unipolar or bipolar. The motor controller may include an asymmetric bridge or half-bridge.

The switchboard controller may be electromechanical or solid-state and may operate the motor at a predetermined speed. The VSD controller may vary the motor speed (and thus the capacity of the pump 65) to achieve an optimum for the given conditions. The VSD may also gradually or soft start the pump 65, thereby reducing start-up strain on the shafts and the power supply and minimizing impact of adverse well conditions.

The seal section 60 may isolate the reservoir fluid 100 being pumped through the pump 65 from the lubricant in the motor 50 by equalizing the lubricant pressure with the pressure of the reservoir fluid 100. The seal section 60 may rotationally couple the motor shaft to a drive shaft of the pump. The shaft seal may house a thrust bearing capable of supporting thrust load from the pump. The seal section 60 may be positive type or labyrinth type. The positive type may include an elastic, fluid-barrier bag to allow for thermal expansion of the motor lubricant during operation. The labyrinth type may include tube paths extending between a lubricant chamber and a reservoir fluid chamber providing limited fluid communication between the chambers.

The pump may include an inlet 65*i*. The inlet 65*i* may be standard type, static gas separator type, or rotary gas separator type depending on the GOR of the reservoir fluid. The standard type intake may include a plurality of ports allowing reservoir fluid 100 to enter a lower or first stage of the pump 65. The standard intake may include a screen to filter particulates from the reservoir fluid. The static gas separator type may include a reverse-flow path to separate a gas portion of the reservoir fluid from a liquid portion of the reservoir fluid.

The pump 65 may be dynamic or positive displacement. The dynamic pump may be centrifugal, such a radial flow or mixed axial/radial flow. The positive displacement pump may be progressive cavity. The pump 65 may include one or more stages (not shown). Each stage of the centrifugal pump may include an impeller and a diffuser. The impeller may be rotationally and longitudinally coupled to the pump shaft, such as by a key. The diffuser may be longitudinally and rotationally coupled to a housing of the pump, such as by compression between a head and base screwed into the housing. Rotation of the impeller may impart velocity to the reservoir fluid 100 and flow through the stationary diffuser may convert a portion of the velocity into pressure. The pump may deliver the pressurized reservoir fluid to an outlet 65*o* of the isolation device 70. Additionally, two pumps may be used in series, such as a first centrifugal pump (one or more stages) and a second progressive cavity pump (one or more stages).

The ESP system 1 may further include an actuator (not shown) for setting and/or unsetting the isolation device 70. The actuator may include an inflation tool, a check valve, and a deflation tool. The check valve may be a separate member or integral with the inflation tool. The inflation tool may be an electric pump and may be in electrical communication with the motor controller or include a separate power supply in direct communication with the power cable 80*r*. Upon activation, the inflation tool may intake reservoir fluid, pressurize the reservoir fluid, and inject the pressurized reservoir fluid through the check valve and into the isolation device. Alternatively, the inflation tool may include a tank filled with clean inflation fluid, such as oil, for inflating the isolation device 70.

The isolation device 70 may include a bladder (not shown), a mandrel (not shown), anchor straps (not shown), and a sealing cover (not shown). The mandrel may include a first fluid path therethrough for passing the reservoir fluid 100 from the pump 65 to the outlet 65*o*, the outlet 65*o*, and a second fluid path for conducting reservoir fluid from the inflation tool to the bladder. The mandrel may further include a path therethrough for electrically coupling the cable 80*r* to the flat cable 80*f* via leads or physically passing the cable 80*r* therethrough. The bladder may be made from an elastomer and be disposed along and around an outer surface of the mandrel. The anchor straps may be disposed along and around an outer surface of the bladder. The anchor straps may be made from a metal or alloy and may engage an inner surface of the casing 10 upon expansion of the bladder, thereby rotationally fixing the mandrel (and the components 50-75) to the casing 10. The anchor straps may also longitudinally couple the mandrel to the casing, thereby relieving the cable 80*r* from having to support the weight of the components 50-75 during operation of the pump 65. The cable 80*r* may then be relegated to a back up support should the isolation device 70 fail.

The sealing cover may be disposed along a portion and around the anchor straps and engage the casing upon expansion of the bladder, thereby fluidly isolating the outlet 65*o* from the intake 65*i*. The deflation tool may include a mechanically or electrically operated valve. The deflation tool may in fluid communication with the bladder fluid path such that opening the valve allows pressurized fluid from the bladder to flow into the wellbore, thereby deflating the bladder. The mechanical deflation tool may include a spring biasing a valve member toward a closed position. The valve member may be opened by tension in the cable 80*r* exceeding a biasing force of the spring. The electrical inflation tool may include an electric motor operating a valve member. The electric motor may be in electrical communication with the motor controller or in direct communication with the cable. Operation of the motor using a first polarity of the voltage may open the valve and operation of the motor using a second opposite polarity may close the valve.

Alternatively, instead of anchor straps on the bladder, the isolation device may include one or more sets of slips, one or more respective cones, and a piston disposed on the mandrel. The piston may be in fluid communication with the inflation tool for engaging the slips. The slips may engage the casing 10, thereby rotationally fixing the components 50-75 to the casing. The slips may also longitudinally support the components 50-75. The slips may be disengaged using the deflation tool.

Alternatively, instead of an actuator, hydraulic tubing (not shown) may be run in with the components 50-75 and extend to the isolation device 70. Hydraulic fluid may be pumped into the bladder through the hydraulic tubing to set the isolation device 70 and relieved from the bladder via the tubing to unset the isolation device 70. Alternatively, the isolation device 70 may include one or more sets of slips (not shown), one or more respective cones (not shown), and a solid packing element (not shown). The actuator may include a power charge, a piston, and a shearable ratchet mechanism. The power charge may be in electrical communication with the motor controller or directly with the cable 80*r*. Detonation of the power charge may operate the piston along the ratchet mechanism to set the slips and the packing element. Tension in the cable 80*r* may be used to shear the ratchet and unset the packing element. Alternatively, hydraulic tubing may be used instead of the power charge. Alternatively, a second hydraulic tubing may be used instead of the ratchet mechanism to unset the packing element. Alternatively, the isolation device 70 may include an expandable element made from a shape memory alloy or polymer and include an electric heating element so that the expandable element may be expanded by operating the heating element and contracted by deactivating the heating element (or vice versa).

Additionally, the isolation device 70 may include a bypass vent (not shown) for releasing gas separated by the inlet 65*i* that may collect below the isolation device and preventing gas lock of the pump 65. A pressure relief valve (not shown) may be disposed in the bypass vent.

In operation, to install the ESP system 1, a workover rig (not shown) and the ESP system 1 may be deployed to the wellsite. Since the cable 80*r* may include only two conductors, the cable 80*r* may be delivered wound onto a drum (not shown). The reservoir 25 may be isolated and the wellhead 15 opened. The components 50-75 may be suspended over the wellbore 5 from the workover rig and an end of the cable 80*r* may be connected to the cablehead 75. The cable 80*r* may be unwound from the drum, thereby lowering the components 50-75 into the wellbore. Once the components 50-75 have reached the desired depth proximate to the reservoir 25, a surface end of the cable 80*r* may be secured to the wellhead 15, the wellhead closed, and the conductors of the cable 80*r* may be connected to the surface controller 45. The workover rig may then be transported from the wellsite. Alternatively, the workover rig may continue to support the components 50-75 until the isolation device 70 is set so the cable 80*r* may be relieved of tension during operation of the pump 65.

Additionally, a downhole tractor (not shown) may be integrated into the cable to facilitate the delivery of the pumping system, especially for highly deviated wells, such as those having an inclination of more than 45 degrees or dogleg severity in excess of 5 degrees per 100 ft. The drive and wheels of the tractor may be collapsed against the cable and deployed when required by a signal from the surface.

The isolation device 70 may then be set. If the isolation device 70 is electrically operated, the surface controller 45 may be activated, thereby delivering the DC power signal to the downhole controller 55 and activating the downhole controller 55. Instructions may be given to the surface controller 45 via the operator interface, instructing setting of the isolation device 70. The instructions may be relayed to the PCM 55 via the cable. The PCM 55 may then operate the actuator. Alternatively, as discussed above, the actuator may be directly connected to the cable. In this alternative, the actuator may be operated by sending a voltage different than the operating voltage of the motor. For example, since the motor may be operated by the medium voltage, the inflation tool may be operated at a low voltage and the deflation tool (if electrical) may be operated by reversing the polarity of the low voltage.

Once the isolation device 70 is set, the motor 50 may then be started. If the motor controller is variable, the motor controller may soft start the motor 50. As the pump 65 is operating, the motor controller may send data from the sensors to the surface so that the operator may monitor performance of the pump. If the motor controller is variable, a speed of the motor 50 may be adjusted to optimize performance of the pump. Alternatively, the surface operator may instruct the motor controller to vary operation of the motor. Once one of the downhole components 50-75 reaches the end of the service life and/or the sensors detect degradation of one of the downhole components 50-75, the workover rig may be redeployed to the wellsite. The operator may send instructions to the motor controller to shut down the pump or simply cut power to the cable 80*r*. The cable 80*r* may be unclamped from the wellhead 15 and connected to the drum. The operator may send instructions to the downhole controller 55 to unset the isolation device 70 (if electrically operated) or the drum may be wound to exert sufficient tension in the cable 80*r* to unseat the isolation device 70. If the isolation device 70 is non-responsive, sufficient tension may be exerted to shear the cable 80*r* from the cablehead 75 and the cable 80*r* may be removed. The fishing tool may then be deployed to retrieve the components 50-75. If the isolation device is successfully unset, the cable 80*r* may be wound, thereby raising the components 50-75 from the wellbore 5. The components 50-75 may then be replaced and redeployed using the cable 80*r* or the cable 80*r* may be replaced as well, if necessary.

Alternatively, if the isolation device 70 is resettable, the workover rig may be redeployed for adjusting the location of the components 50-75 in the wellbore to compensate for changing conditions of the reservoir 25.

Advantageously, deployment of the components 50-75 using the cable 80*r* instead of a production tubing string reduces the required size of the workover rig and the manpower required to deploy the components 50-75 into and remove the components 50-75 from the wellbore. Using the casing 10 to conduct the reservoir fluid 100 to the surface 20 instead of the production tubing reduces frictional pressure loss in the fluid, thereby reducing the required capacity of the motor and pump for a given flow rate. Transmitting a DC power signal through the cable 80*r* reduces the required diameter of the cable, thereby allowing a longer length of the cable 80*r* (i.e., five thousand to eight thousand feet) to be spooled onto a drum, and easing deployment of the cable 80*r*.

While the foregoing is directed to embodiments of the present invention, other and further embodiments of the invention may be devised without departing from the basic scope thereof, and the scope thereof is determined by the claims that follow.

The invention claimed is:

1. A method of producing fluid from a reservoir, comprising:

deploying a downhole assembly of a pumping system into a wellbore to a location proximate the reservoir using a cable, wherein:

the cable has one or more layers of high strength metal or alloy armor capable of supporting a deployment weight of the downhole assembly of at least 2,000 pounds, the cable has two or less conductors, the conductors are made from aluminum, copper, or an alloy thereof, the downhole assembly comprises a motor, an isolation device, a pump, and a power conversion module (PCM), and the isolation device has an expandable seal and an anchor;

setting the isolation device, thereby rotationally fixing the downhole assembly to a tubular string disposed in the wellbore and isolating an inlet of the pump from an outlet of the pump;

supplying a direct current (DC) power signal from surface to the PCM via the cable; and after setting the isolation device, supplying a second power signal from the PCM to the motor, thereby starting and operating the pump and pumping reservoir fluid from the reservoir to the surface, wherein:

the downhole assembly further comprises a sensor, and the method further comprises transmitting a measurement by the sensor to the surface via the cable.

2. The method of claim 1, further comprising unsetting the isolation device.

3. The method of claim 2, wherein the isolation device is unset by sending a signal via the cable from a surface controller.

4. The method of claim 2, wherein the isolation device is unset by exerting tension on the cable.

5. The method of claim 2, further comprising moving the downhole assembly to a second location in the wellbore using the cable; and resetting the isolation device.

6. The method of claim 2, further comprising removing the downhole assembly from the wellbore using the cable.

7. The method of claim 1, further comprising controlling a speed of the motor.

8. The method of claim 1, wherein the sensor is selected from a group, consisting of:

a pressure sensor in communication with the pump outlet,
a temperature sensor in communication with the PCM,
a vibration sensor in communication with the pump, and
a flow meter in communication with the pump outlet.

9. The method of claim 1, wherein the PCM converts the DC power signal into an AC power signal and the second signal is the AC power signal.

10. The method of claim 9, wherein the AC power signal is three phase.

11. The method of claim 9, wherein the DC power signal is substantially greater than one kilovolt and the AC signal is substantially greater than one kilovolt.

12. The method of claim 1, wherein the tubular string is a casing string cemented to the wellbore and the reservoir fluid is pumped to the surface via a bore of the casing string.

13. The method of claim 1, wherein the isolation device is set by sending a signal via the cable.

14. The method of claim 1, wherein the isolation device longitudinally fixes the downhole assembly to the tubular string, thereby supporting a weight of the downhole assembly.

15. The method of claim 1, wherein the cable is coaxial comprising the two conductors, the DC power signal is supplied via the conductors, and a data signal is multiplexed with the DC power signal.

16. The method of claim 9, wherein the DC power signal is substantially greater than one kilovolt and the AC signal is less than or equal to one kilovolt.

17. The method of claim 1, wherein:

the second power signal is three phase,
the motor is induction or switched reluctance, and
the pump is centrifugal.

18. The method of claim 17, wherein the pump is multi-stage.

19. The method of claim 1, wherein the high strength metal or alloy is steel or nickel alloy.

20. The method of claim 1, wherein the deployment weight is at least 10,000 pounds.

21. A pumping system, comprising:

a submersible electric motor operable to rotate a drive shaft;
a pump rotationally fixed to the drive shaft;
an isolation device having an expandable seal and an anchor and operable to expand into engagement with a casing string, thereby fluidly isolating an inlet of the pump from an outlet of the pump and rotationally fixing the motor and the pump to the casing string;
an actuator for expanding the isolation device independently of the pump;
a cable having two or less conductors made from aluminum, copper, or an alloy thereof and one or more layers of high strength metal or alloy armor having a strength sufficient to support a deployment weight of the cable, the motor, the pump, the actuator, the isolation device, and a power conversion module (PCM),
wherein the deployment weight is at least 2,000 pounds; and
the PCM operable to receive a DC power signal from the cable conductors, and supply a second power signal to the motor,
wherein:
the pumping system further comprises a sensor, and
a device operable to send a measurement from the sensor along the cable.

22. The pumping system of claim 21, wherein the PCM is further operable to convert the DC power signal to an AC power signal and the second power signal is the AC power signal.

23. The pumping system of claim 22, wherein the AC power signal is three-phase.

24. The pumping system of claim 22, wherein the DC signal is substantially greater than one kilovolt and the AC signal is substantially greater than one kilovolt.

25. The pumping system of claim 21, wherein the PCM is further operable to vary a speed of the motor.

26. The pumping system of claim 21, wherein the actuator comprises an inflation tool for setting the isolation device.

27. The pumping system of claim 26, wherein the inflation tool is an electric pump.

28. The pumping system of claim 21, wherein the sensor is selected from a group, consisting of:

a pressure sensor in communication with the pump outlet,
a temperature sensor in communication with the PCM,
a vibration sensor in communication with the pump, and
a flow meter in communication with the pump outlet.

29. The pumping system of claim 21, wherein the isolation device is further operable to support the weight of the motor, the pump, the isolation device, actuator, and the PCM.

30. The pumping system of claim 21, wherein the isolation tool is operable to be reset without removal from the casing string.

31. The pumping system of claim 21, wherein the cable is coaxial comprising the two conductors and the PCM is further operable to demultiplex a data signal from the two conductors.

32. The pumping system of claim 22, wherein the DC signal is substantially greater than one kilovolt and the AC signal is less than or equal to one kilovolt.

33. The pumping system of claim 21, wherein:

the second power signal is three phase,
the motor is induction or switched reluctance, and
the pump is centrifugal.

34. The pumping system of claim 33, wherein the pump is Multi-stage.

35. The pumping system of claim 21, wherein the high strength metal or alloy is steel or nickel alloy.

36. The pumping system of claim 21, wherein the deployment weight is at least 10,000 pounds.

* * * * *